US005924859A

United States Patent [19]

Nolte et al.

[11] Patent Number: 5,924,859

[45] Date of Patent: Jul. 20, 1999

[54] PROCESS AND CIRCUIT FOR CONTROLLING A GAS BURNER

[75] Inventors: Hubert Nolte; Martin Herrs, both of Höxter, Germany

[73] Assignee: Stiebel Eltron GmbH & Co.KG, Holzminden, Germany

[21] Appl. No.: 08/736,077

[22] Filed: Oct. 24, 1996

Related U.S. Application Data

[30] Foreign Application Priority Data

Oct. 25, 1995 [DE] Germany ..... 195 39 568
May 9, 1996 [DE] Germany ..... 196 18 573

[51] Int. Cl.[6] ..... F23N 5/12

[52] U.S. Cl. ..... 431/12; 431/25; 431/18; 431/78; 431/75

[58] Field of Search ..... 431/12, 18, 75, 431/78, 24, 25

[56] References Cited

U.S. PATENT DOCUMENTS 4,588,372 5/1986 Torborg ..... 431/78

FOREIGN PATENT DOCUMENTS 0 104 586 4/1984 European Pat. Off. .
39 37 290 A1 5/1990 Germany .
41 21 924 C2 6/1995 Germany .
44 33 425 A1 3/1996 Germany .
1577525 12/1981 Japan ..... 431/12
49623 3/1988 Japan ..... 431/12
402143018 6/1990 Japan ..... 431/75
8 403 840 7/1986 Netherlands .

*Primary Examiner*—Carl D. Price
*Attorney, Agent, or Firm*—McGlew and Tuttle, P.C.

[57] ABSTRACT

A process for controlling a gas blower burner in which an ionization electrode sends an electrical variable derived from the combustion temperature or the lambda value to a control circuit, which compares this variable with a selected electrical set point and adjusts the gas-to-air ratio (lambda value) to a corresponding lambda set point. To compensate the effect of a condition-dependent change in the proportionality between the lambda value and the electrical measured variable derived from it on the control in such a way that the desired lambda set point will be maintained, a calibration cycle is run from time to time. The lambda value is reduced from a value of >1 during this cycle. The maximum obtained at lambda=1 is stored. The electrical set point is adjusted with this maximum.

16 Claims, 2 Drawing Sheets

PROCESS AND CIRCUIT FOR CONTROLLING A GAS BURNER

BACKGROUND OF THE INVENTION

Such a control is described in DE 39 37 290 A1. The ionization electrode is located in a d.c. circuit there. The evaluation of the ionization current is problematic in practice if a proportional relationship is to be determined between the ionization current and the lambda value.

A control device for a gas blower burner is described in the older patent application P 44 33 425. The ionization current can be reliably evaluated by superimposing an a.c. voltage. The current air excess (lambda value) of the current state of combustion is determined by means of an ionization electrode and is compared with a set point set in the control circuit. The composition of the gas-combustion air mixture is adjusted correspondingly, so that a desired lambda set point is maintained as an end result. A superstoichiometric ratio of air to gas is desired, and the lambda set point is preferably between 1.15 and 1.3. It is achieved as a result that optimal combustion takes place in terms of the emissions and the firing technical efficiency with different types of gas, e.g., natural gas and liquefied gas, and under varying ambient conditions.

The thermal coupling between the ionization electrode and the gas burner may change during the operation, e.g., due to bending, wear and contamination of the ionization electrode or fouling of the burner. This was found to lead to changes in the ionization current and consequently in the measured variable derived from it despite a constant lambda value. Consequently, the proportionality factor between the lambda value and the electrical variables derived from it changes. Since this changed measured voltage is present at the comparator of the control circuit, on which the set point, which is unchanged, also acts, the control circuit will adjust the gas-to-air mixture, i.e., the lambda value, as a result of which a deviation of the actual lambda value from the lambda set point will take place, which is undesirable.

SUMMARY AND OBJECTS OF THE INVENTION

The primary object of the present invention is to suggest a process and a circuit of the above-mentioned type, with which process and circuit the effect of a change in the proportionality between the lambda value and the electrical measured variable derived from it on the control is compensated such that the desired gas-to-air ratio (lambda set point) is maintained.

According to the invention, a process is provided for controlling a gas burner, especially a gas blower burner, with a measuring electrode, especially an ionization electrode, which sends an electrical variable (ionization signal) derived from the combustion temperature or the lambda value to a control circuit, which compares this variable with a selected electrical set point and sets the gas-to-air ratio (lambda value) to a corresponding lambda set point. The process includes, after a certain operating time or at regular intervals, running a compulsory calibration cycle, during which the lambda value is reduced from a value>1 and during which the electrical variable (ionization signal) developing is measured. The maximum of the ionization signal (A, B, C) is stored, and that the electrical set point is adjusted with this maximum in order for the control circuit to make an adjustment to the same lambda set point.

The invention also includes a circuit for controlling a gas burner, especially a gas blower burner with a measuring electrode, especially an ionization electrode, which sends an electric measured variable (ionization signal) corresponding to the combustion temperature (lambda value) to the control circuit, wherein a comparator in the control circuit compares the current electrical measured variable (ionization signal) with a selected set point of a setting means and adjusts the gas-to-air ratio to a lambda set point. A change-over switch is provided for interrupting the control and a ramp generator is provided for reducing the gas-to-air ratio beginning from a lambda value of >1. The electrical measured variable (U) passes through a curve (I, II, III), and a recognition and memory circuit detects the value of the measured variable at the maximum (A, B, C) of the curve (I, II, III) and stores it, and adjusts the setting means to this value, which is used as a basic value.

After a certain operating time, which can be determined either by a running time meter or by counting the number of times the burner is switched on, the control is briefly switched off and a calibration cycle is run. The gas-to-air ratio is compulsorily made richer, i.e., the lambda value is reduced beginning from >1, during this cycle. The electrical measured variable passes through a maximum at lambda=1. This value is fixed. If it deviates from the basic electrical set point set, the latter is adjusted. Such a deviation arises if the ionization electrode is bent, worn or fouled, which in itself would lead to an undesired change in the gas-to-air ratio. Such a change is avoided by the present invention, so that the desired lambda set point is set by the control even if the proportionality factor existing between the combustion temperature and the electrical measured variable has changed.

After the calibration cycle, optionally after the evaluation of one or more transfer criteria, a switching over to "control" is again performed. If the deviation is outside a "window," an interfering signal is generated and/or the burner is switched off compulsorily.

The process preferably initiates a calibration cycle after a certain number of operating hours or after a certain number of times the gas burner is switched on.

If the maximum (A, B, C) is outside a predetermined window (F), an interfering signal preferably appears. The lambda value passes through a range from a value of >1 to a value below 1 during the calibration cycle. During the calibration cycle, the lambda value of >1 is preferably at least as high as the lambda set point that can be set. The control signal (J) for a the gas solenoid valve is first brought in each calibration cycle to a valve suitable for the preheating of the said ionization electrode, and the control signal (J) is then increased until the maximum of the ionization signal (Ui) is passed through, and the value obtained is evaluated for the calibration.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
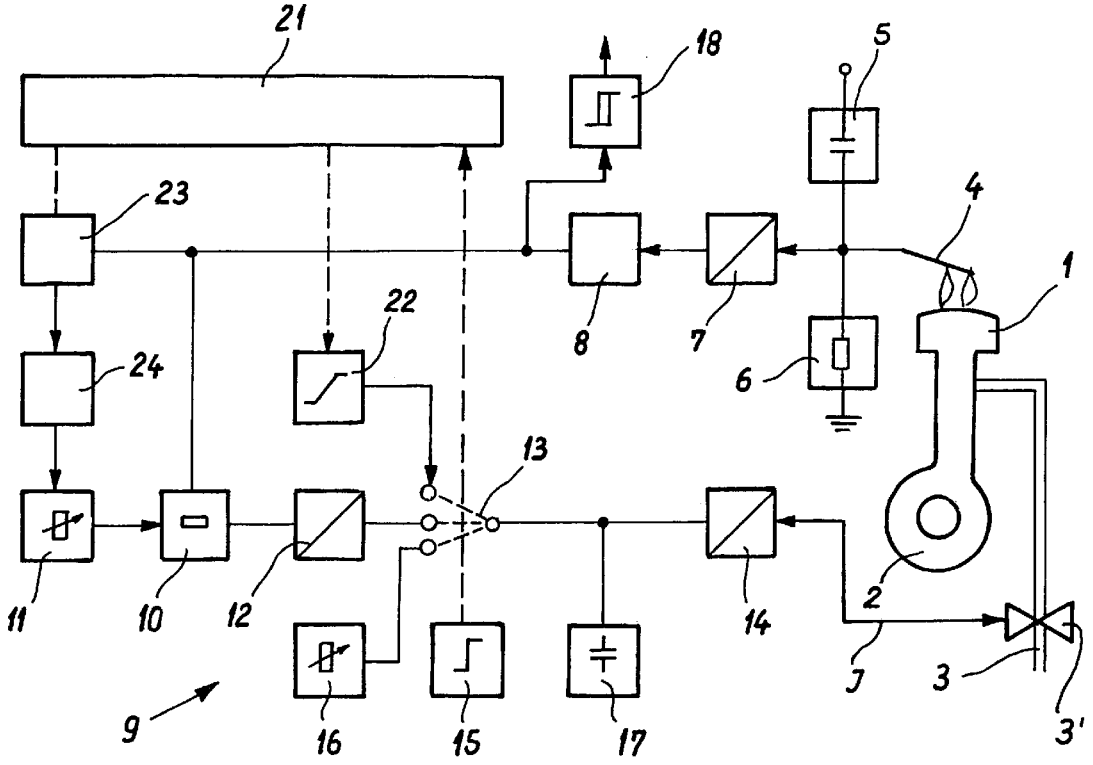
FIG. 1 is a block diagram of a control circuit in a gas blower burner according to the invention.

A gas burner 1 has a speed-controllable blower 2, which supplies combustion air. It is provided with a gas feed line 3, in which a gas solenoid valve 3' is arranged. An ionization electrode 4 acting as a measuring electrode is arranged in the flame area of the gas burner 1. This measuring electrode 4 is common in gas burners. However, it is usually used for flame monitoring only. The measuring electrode 4 detects the ionization current that becomes established under the current state of combustion. According to Richardson's equation, this current depends on the electrode temperature and consequently also on the current lambda value of the current gas-to-air mixture.

An a.c. voltage, simply the a.c. voltage of the power supply in the example, is applied to the measuring electrode 4 via a capacitive coupling member 5. The coupling member 5 is grounded via a resistor 6, so that the ionization path flame area is connected electrically in parallel to the resistor 6.

A low-pass filter 8, which is connected on the output side to a control circuit 9, is connected to the measuring electrode 4 via a voltage-impedance converter 7.

The control circuit 9 according to FIG. 1 has a comparator 10, to which a setting means 11 is connected. An electrical set point corresponding to the desired lambda value, e.g., 1.15 to 1.3, can be set on the setting means 11. The d.c. output voltage of the low-pass filter 8, which is proportional to the current lambda value, is sent to the comparator 10. On the output side, a voltage/current converter 12 is connected to the comparator 10, and the said voltage/current converter 12 is connected via a change-over switch 13 to a power driver 14, which controls the speed of rotation of the blower 2 and/or the position of the gas solenoid valve 3'.

An automatic starting unit 15, which controls the change-over switch 13, is integrated within the control circuit 9. A setting means 16 for a starting speed is connected to the change-over switch 13. In addition, a controller memory 17 for the instantaneous speed value and/or the instantaneous setting value of the gas solenoid valve 3' is provided.

Furthermore, a Schmitt trigger 18, which is used for flame monitoring, is connected to the output of the low-pass filter 8.

The mode of operation of the control circuit described so far is substantially as follows:

At the start of the gas burner 1, the automatic starting unit 15 switches to the setting means 16. As a result, the blower 2 runs via the power driver 14 at a starting speed, which leads to a reliably ignitable mixture.

After ignition and successful development of the flame, the automatic starting unit 15 switches the change-over switch 13 to the voltage/current converter 12. The ionization current detected by the ionization electrode 4 causes a d.c. voltage to be superimposed to the a.c. voltage. This d.c. voltage is proportional to the ionization in the flame area. It is proportional to the current air excess lambda. In practice, it is between 0 V and 200 V. For further processing, the voltage is reduced, and a d.c. voltage between 0 V and 10 V appears at the output of the low-pass filter 8 in the example.

The actual or measured ionization voltage signal Ui incorporating the air excess of the current gas-air mixture is compared with a desired ionization set point in the comparator 10. The difference between the two values is converted into a current, which corresponds to the state of charging of the memory capacitor 17, which corresponds to the instantaneous speed value, changes and thus correspondingly controls the speed of the blower 2 until the current air excess actual lambda value becomes equal to the lambda set point.

If the combustion conditions change thereafter, e.g., there is a change in the type of gas, the gas pressure, the ambient temperatures, etc., and the actual lambda value deviates from the lambda set point as a result, these disturbances are stabilized in the manner described.

When the flame goes out, the gas feed line 3 is blocked by means of the gas solenoid valve 3'.

The speed of the blower 2 or the gas feed line 3 is controlled to set the air excess.

The control circuit 9 may also be designed as a digital circuit with a microprocessor.

In addition, an activating circuit 21 is provided. It counts the starts triggered by the automatic starting unit 15 or determines the operating hours of the gas burner 1. A ramp generator 22, which is connected to a third switching position of the change-over switch 13, is connected to the activating circuit 21.

A recognition circuit 23, which is likewise connected to the activating circuit 21 and is followed by a memory circuit 24, is connected to the output of the low-pass filter 8. The memory circuit 24 is connected to the setting means 11.

The mode of operation of the additional circuit during a calibration cycle is as follows:

After a defined number of starts or operating hours, e.g., 100 starts or 10 operating hours, the activating circuit 21 brings the change-over switch 13 into its third switching position and activates the ramp generator 22. The above-described control is switched off as a result.

Figure 2:
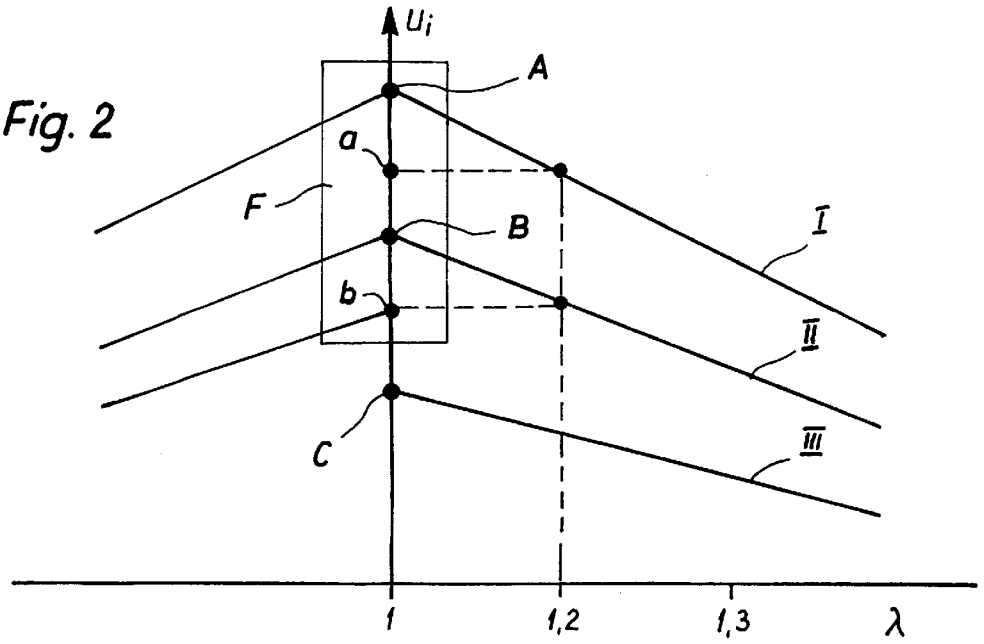
FIG. 2 is a control characteristic diagram.

The ramp generator 22 now controls the blower 2 or the gas solenoid valve 3' in such a way that the gas-air mixture is made "richer," i.e., the percentage of gas increases. The lambda value is now continuously reduced from a value of >1, e.g., 1.3, to a value below 1. The course of the measured or actual ionization voltage signal Ui at the output of the low-pass filter 8, which is derived from the ionization electrode 4 and is illustrated as an example by the curves I, II, and III in FIG. 2, is thus obtained. Which of the curves becomes established depends on the state of the ionization electrode 4 or of the gas burner 1, i.e., on how the ionization electrode 4 is located in the area adjoining the burner flames. For example, a different voltage curve is obtained in the case of a bent, worn or fouled ionization electrode 4 than under "good" conditions.

All curves I, II, III pass through a maximum at lambda =1. The maxima of the curves I, II, III are designated by A, B, C in FIG. 2.

The recognition circuit 23 detects the current voltage maximum A, B, C, e.g., by evaluating the slope of the curve I, II or III. The current maximum voltage is stored in the memory circuit 24. The memory circuit 24 sets the base value 100% of the setting means 11 to this value.

If it is assumed that, e.g., I is the characteristic of a "good" condition of the ionization electrode 4, and it is assumed that the lambda set point shall be 1.2, the setting means 11 was set such that it was set to 90% of its base value 100% cf. a in FIG. 2, which is not true to scale.

As long as there is no change in the state of the ionization electrode 4 or of the gas burner 1, there will also be no change in the base value 100% of the setting means 11 during the calibration cycles.

If the characteristic II with the maximum B is obtained in a calibration cycle, which is the consequence of a change in the state of the ionization electrode 1, this voltage value B is stored as a base value for the setting means 11 in the memory circuit 24. The setting means 11 continues to be set at 90% of a base value, which is shown by b in FIG. 2. As can be seen from FIG. 2, an adjustment to the lambda set point of 1.2 is performed via the comparator 10 when the control is again switched on after the calibration cycle by means of the change-over switch 13 in the case of the voltage b 90% of the maximum voltage B.

It is consequently achieved that depending on the current state of the ionization electrode 4, the control circuit 9 is always adjusted such that the control circuit 9 adjusts the actual lambda value to the desired lambda set point in the controlled operation. Operation-related changes in the state of the ionization electrode 4 or of the gas burner 1 are consequently compensated.

There are limits to the above-described adjustment of the setting means 11. These are indicated by the window F in FIG. 2. As long as the maximum of the voltage curves, such as A, B, are located within the window F during the calibration cycles, the above-described adjustment of the setting means 1 takes place. If a voltage maximum, e.g., C, which is located outside the window F, is obtained, this is recognized by the recognition circuit 23 and it triggers an interfering signal and/or a forced switching off of the gas burner 1.

The calibration cycles are very short compared with the times during which the gas burner 1 operates in normal, controlled operation, so that the combustion taking place with a lambda value deviating from the lambda set point can be accepted during the calibration cycles. Combustion improves during a controlled operation following a calibration process.

Variants of the above-described calibration processes will be explained below.

The above-described control function is switched off during the calibration. The calibration is preferably performed at a non-changing speed of rotation of the blower 2 in order to suppress the effect of the blower 2 on combustion. It is favorable for the calibration to be performed at a medium speed of rotation in order not to reach modulation limits of the control signal J, which is sent to the gas solenoid valve 3'. The calibration may also be performed during the switching over of the blower 2 from one power stage to the other power stage, because the change in speed of rotation is slow compared with the calibration process, so that the speed of rotation is quasi constant during the calibration process.

Figure 3:
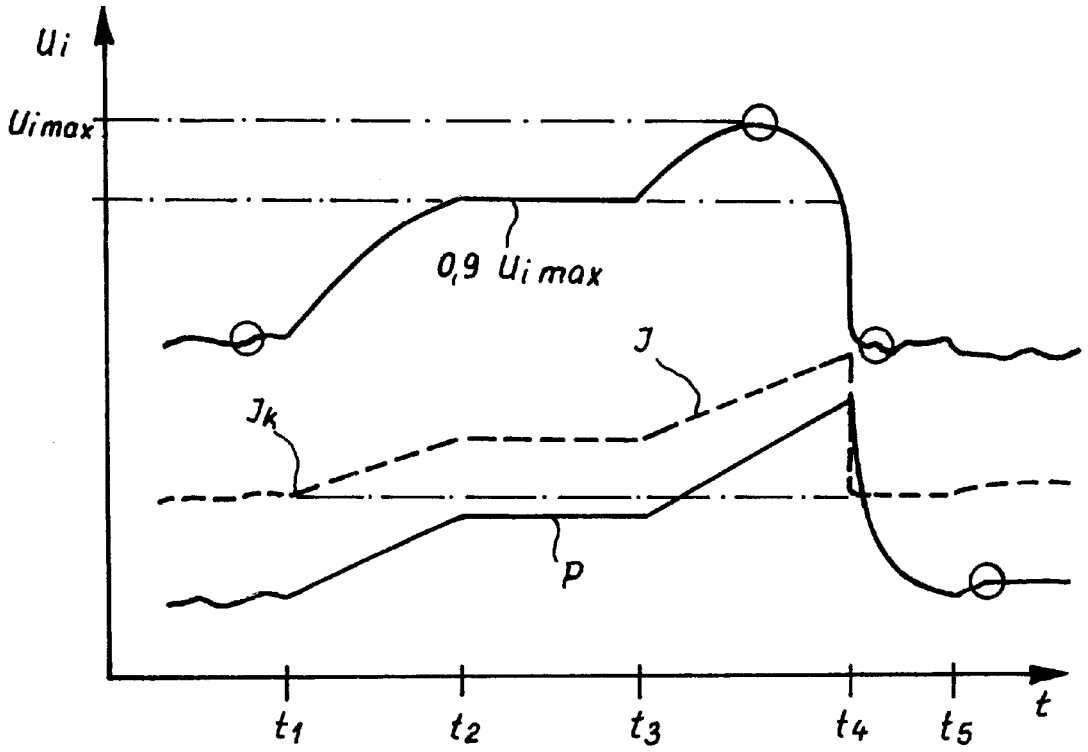
FIG. 3 is a time diagram at the start of a calibration process.

The calibration process is started at time t1 cf. FIG. 3 by the event counter or running time meter at the time of transition from the full load stage to the partial load stage of the blower 2, when the decreasing modulation current J reaches a low value Jk. The modulation current J and consequently, via the gas solenoid valve 3', the amount of gas feed are then increased by the control circuit 9, as a result of which the ionization voltage Ui increases correspondingly. The ionization voltage Ui reaches a predetermined value, e.g., 0.9 Uimax, at the time t2. The time interval t1 to t2 is used to start up the preheating of the ionization electrode 4. The modulation current J is maintained at a constant value beginning from time t2 until time t3. The ionization electrode 4 is heated during this period t2 to t3 to a stable temperature, as a result of which it guarantees reproducible measured values.

After time t3, the modulation current J is further increased by the control circuit 9 such that the maximum value Uimax and/or the measured values obtained during the time period t3 to t4 is/are stored for further processing during the calibration process.

The modulation current J is increased further until the ionization voltage Ui is again about 10% below the Uimax value, which happens at time t4 in FIG. 3. The lambda value of the combustion is unfavorable per se during the time period t3 to t4, but it is not significant, because the duration of this period is at most a few seconds.

After the time t4, the control circuit 9 switches back again to the above-described control process. This begins when the ionization voltage Ui, the modulation current J, and the gas pressure p have stabilized at the time t5.

The control circuit 9 derives a correspondingly adjusted, new set point for the ionization voltage from the stored, new maximum of the ionization voltage and from the measured values obtained during the period t3 to t4.

Based on the said short scanning period of the control circuit 9, a series of measured values will also be obtained during the period t3 to t4. Measured values deviating greatly from the other measured values of the series are suppressed, because they may be due to external interfering electrical impulses.

To reduce the effect of only transient, though unusual, but still tolerable calibration measured value series, an averaging may be performed between the new measured value series and the measured value series of preceding calibration processes.

Before a recalibration of the set point of the ionization voltage is indeed performed with the new calibration value, which may be derived from the new maximum of the ionization voltage or from the measured value series, two transfer criteria are checked by the control circuit 9.

The first transfer criterion detects a sudden change in all components of the control circuit. This criterion is satisfied if the deviation of the new calibration value from the previous calibration values is sufficiently small. The second transfer criterion detects a "slow drift" of the system (burner control), which is sufficiently small in the case of a deviation from values intended by the manufacturer.

The burner operation is continued with the recalibration only if both transfer criteria are satisfied. If one of the transfer criteria is not satisfied, the burner operation is interrupted first by a controlled shutoff and, after several repetitions, by a disturbance shutoff.

While specific embodiments of the invention have been shown and described in detail to illustrate the application of the principles of the invention, it will be understood that the invention may be embodied otherwise without departing from such principles.

What is claimed is:

1. A process for controlling a gas burner, with a measuring ionization electrode, the process comprising the steps of:

sending an ionization signal derived from combustion of the burner to a control circuit;

comparing said ionization signal with a selected electrical set point at the control circuit to set a gas-to-air ratio (lambda value) of the combustion to lambda set point corresponding to said selected electrical set point;

periodically running a calibration cycle including reducing the lambda value from a value >1 to a value <1, measuring, during said step of reducing, said ionization signal, storing a maximum of said ionization signal, and adjusting said electrical set point based on said maximum of said ionization signal, and thereby adjusting, with said control circuit, said lambda set point.

2. A process in accordance with claim 1, wherein:

said periodic running includes a time period formed by one of a certain number of operating hours or a certain number of times the gas burner is switched on.

3. A process in accordance with claim 1 wherein:

an interfering signal appears if said maximum is outside a predetermined window.

4. A process in accordance with claim 1, wherein during said calibration cycle, the lambda value of >1 is a maximum lambda set point possible by the burner.

5. A process in accordance with claim 1, wherein the gas burner has a gas solenoid valve and said control circuit generates a signal (J) for said gas solenoid valve, said control signal (J) is first brought in each calibration cycle to a value for a preheating of said ionization electrode, and the control signal (J) is then increased until said maximum of the ionization signal (Ui) is passed through, and obtained for said calibration cycle.

6. A circuit for controlling a gas burner, comprising:

a measuring electrode;

a control circuit, said measuring electrode sending an electrical measured variable (U) signal corresponding to a combustion temperature (lambda value) of the burner to the control circuit, said control circuit including a comparator comparing a current said electrical measured variable signal with a selected electrical set point of a setting means and adjusts a gas-to-air ratio of the burner to a lambda set point corresponding to said selected electrical set point, a change-over switch for interrupting adjustment by said setting means and a ramp generator for reducing the gas-to-air ratio beginning from a lambda value of >1 to a lambda<1, wherein said electrical measured variable (U) is varied to form a curve, a recognition and memory circuit for detecting a value of the measured variable at a maximum of the curve and for storing said values and adjusting means for adjusting said selected electrical set point based on said value.

7. A circuit in accordance with claim 6, wherein said measuring electrode is an ionization measuring electrode.

8. A circuit in accordance with claim 6, wherein:

said selected electrical set point is established at a value less than said maximum value of said curve.

9. A circuit in accordance with claim 6, wherein:

said selected electrical set point is established at a percentage less than said maximum value of said curve.

10. A process in accordance with claim 1, wherein:

said selected electrical set point is established at a value less than said maximum value of said curve.

11. A process in accordance with claim 1, wherein:

said selected electrical set point is established at a percentage less than said maximum value of said curve.

12. A process for controlling a burner, the process comprising the steps of:

combusting fuel and air in the burner;

measuring an ionization signal from said combusting to create an actual ionization signal;

comparing said actual ionization signal with a desired ionization set point;

varying a feeding of one of the fuel and air for said combusting to minimized a difference between said actual ionization signal and said desired ionization set point;

periodically performing a calibration cycle, said calibration cycle including:

varying said feeding of one of said fuel and air to vary a lambda value of said combusting from greater than one to less than one;

determining a maximum of said actual ionization signal during said varying of said lambda value;

adjusting said desired ionization set point based on said maximum of said actual ionization signal.

13. A process in accordance with claim 12, wherein:

said desired ionization set point is established at a value less than said maximum of said actual ionization signal.

14. A process in accordance with claim 12, wherein:

said desired ionization set point is established as a percentage less than said maximum of said actual ionization signal.

15. A process in accordance with claim 12, further comprising:

generating an interfering signal when said maximum of said actual ionization signal is outside a predetermined range.

16. A process in accordance with claim 17, further comprising:

stopping said combusting when said maximum of said actual ionization signal is outside a predetermined range.

* * * * *